United States Patent [19]

Frantz

[11] Patent Number: 4,585,707

[45] Date of Patent: Apr. 29, 1986

[54] HIGH EXPANSION ALLOY FOR BIMETAL STRIP

[75] Inventor: Earl L. Frantz, Reading, Pa.

[73] Assignee: Carpenter Technology Corporation, Reading, Pa.

[21] Appl. No.: 489,938

[22] Filed: Apr. 29, 1983

[51] Int. Cl.[4] ..... C22C 38/38

[52] U.S. Cl. ..... 428/619; 75/128 A; 148/38

[58] Field of Search ..... 75/128 A; 148/38, 12 E; 428/616, 617, 619, 607

[56] References Cited

U.S. PATENT DOCUMENTS

| | | | |
|---|---|---|---|
| 1,803,467 | 5/1931 | Driver et al. | 75/128 A |
| 1,929,655 | 10/1933 | Scott | 428/616 |
| 1,993,020 | 3/1935 | Scott | 297/15 |
| 2,133,291 | 10/1938 | Gordon | 29/189 |
| 2,146,389 | 2/1939 | Waltenberg | 428/619 |
| 2,449,023 | 9/1948 | Thornton | 148/31 |
| 3,266,876 | 8/1966 | Long et al. | 75/123 K |
| 3,625,663 | 12/1971 | Majesko | 428/619 |

FOREIGN PATENT DOCUMENTS

| | | | |
|---|---|---|---|
| 0737002 | 9/1955 | United Kingdom | 75/128 A |

*Primary Examiner*—L. Dewayne Rutledge
*Assistant Examiner*—Deborah Yee
*Attorney, Agent, or Firm*—Edgar N. Jay

[57] ABSTRACT

An austenitic alloy useful as the high thermal expansion element of a temperature-sensitive bimetal strip. The alloy consists essentially of about 0.5 w/o Max. carbon, 3.0–7.0 w/o manganese, 2.5–4.0 w/o chrominum, 16.0–22.0 w/o nickel and the balance essentially iron, except for incidental impurities.

3 Claims, No Drawings

HIGH EXPANSION ALLOY FOR BIMETAL STRIP

BACKGROUND OF THE INVENTION

This invention relates to a high thermal expansion alloy and, more particularly, to an austenitic nickel-chromium-manganese ferrous-base alloy. The alloy is especially well suited for use as the high expansion element of a temperature-sensitive bimetal strip that can be used, for example, to indicate temperature changes of the bimetal or to indicate changes in electrical current through the bimetal.

A high thermal expansion alloy, which has long been used in temperature-sensitive bimetals, has been sold under the designation 22-3 alloy. This alloy has a nominal composition of about 0.1 weight percent (w/o) carbon, 0.5 w/o manganese, 0.25 w/o silicon, 3.1 w/o chromium, 22 w/o nickel and the balance iron except for incidental impurities. 22-3 alloy features a high coefficient of thermal expansion and good atmospheric corrosion resistance. Essential to these properties of 22-3 alloy has been its austenitic microstructure at room temperature.

However, in making a temperature-sensitive bimetal from 22-3 alloy, the alloy has typically been subjected to the following processing: (a) mechanically bonding (e.g., cold bonding) a strip of the alloy to a strip of a low thermal expansion alloy such as the 36% nickel, balance iron alloy sold under the trade designation Invar "36"; (b) sintering the resulting mechanically bonded bimetal laminate in a reducing atmosphere (e.g., dissociated ammonia or hydrogen) to enhance, by diffusion, the mechanically produced bond; and (c) then cold rolling the laminate significantly to a reduced thickness which is generally more than about 50% thinner, and frequently more than about 70% thinner, than before cold rolling. During such processing, the microstructure of 22-3 alloy frequently has been partially transformed from austenite to a ferritic crystal structure such as martensite. This has reduced the thermal expansivity of 22-3 alloy and thereby reduced the flexivity of the bimetal made from the alloy. In this regard, there has frequently been a significant transformation of austenite to a ferritic crystal structure in 22-3 alloy and a resultant significant reduction in the expansivity of the alloy: (a) when the alloy has been significantly decarburized during the sintering in the reducing atmosphere and subsequently cooled to room temperature; and/or (b) when the alloy has been significantly cold worked by being cold rolled to more than about a 50% reduction in thickness.

Hence, a high expansion, austenitic alloy has been sought which can be used in a temperature-sensitive bimetal as a substitute for 22-3 alloy. In this regard, an alloy has been sought with: (a) properties, such as thermal expansivity, electrical resistivity, corrosion resistance, tensile strength and hardness, that are comparable to 22-3 alloy; but (b) more resistance than 22-3 alloy to the transformation of its austenite to a ferritic crystal structure when the alloy is significantly decarburized and/or cold worked.

SUMMARY OF THE INVENTION

In accordance with this invention, an austenitic high expansion alloy is provided, the broad and preferred forms of which are conveniently summarized as consisting essentially of about:

| Elements | Broad Ranges (w/o) | Preferred Ranges (w/o) |
|---|---|---|
| C | 0.5 Max. | 0.2 Max. |
| Mn | 3.0–7.0 | 4.5–6.5 |
| Si | 0.8 Max. | 0.5 Max. |
| Cr | 2.5–4.0 | 2.75–3.5 |
| Ni | 16.0–22.0 | 17.5–20.0 |

The balance of the alloy is iron except for incidental impurities which can comprise: up to about 0.05 w/o, preferably less than about 0.025 w/o, phosphorus; up to about 0.05 w/o, preferably less than about 0.025 w/o, sulfur; up to about 0.25 w/o, preferably less than about 0.15 w/o, copper; up to about 1.0 w/o, preferably less than about 0.5 w/o, cobalt; up to about 0.25 w/o, preferably less than about 0.15 w/o, molybdenum; up to about 0.025 w/o, preferably less than about 0.010 w/o, nitrogen; and up to about 0.5 w/o, preferably less than about 0.25 w/o, of elements such as aluminum, magnesium and titanium used in refining the alloy. The alloy can also comprise additional elements which do not significantly detract from the desired properties of the alloy or result in the formation of a significant amount of a ferritic crystal structure or otherwise render the desired room temperature austenitic structure of the alloy unstable so that its properties, particularly thermal expansivity, electrical resistivity and atmospheric corrosion resistance, differ significantly from 22-3 alloy.

In the foregoing tabulation, it is not intended to restrict the preferred ranges of the elements of the alloy of this invention for use solely in combination with each other. Thus, one or more of the preferred ranges can be used with one or more of the broad ranges for the remaining elements. In addition, a preferred range limit for an element can be used with a broad range limit for that element.

The alloy of this invention can be used in temperature-sensitive bimetals as a substitute for 22-3 alloy. The alloy of this invention has: (a) thermal expansivity, electrical resistivity, corrosion resistance, tensile strength and hardness properties comparable to 22-3 alloy; but (b) significantly more resistance than 22-3 alloy to the transformation of its austenite to a ferritic crystal structure when the alloy is significantly decarburized and/or cold worked.

DETAILED DESCRIPTION OF THE INVENTION

In the austenitic high thermal expansion alloy of this invention, only the elements manganese, chromium, nickel and iron are essential. All remaining elements are optional or are present as a result of the steelmaking process or as incidental impurities. For example, silicon is preferably used as a deoxidizer in preparing the alloy, but aluminum, magnesium and/or titanium can also be used as deoxidizers.

Nickel imparts resistance to atmospheric corrosion to the alloy of this invention. At least about 16.0 w/o nickel is required in the alloy of this invention so that its austenitic balance can be established. Above about 22.0 w/o, nickel tends to adversely affect the thermal expansivity of the alloy. Preferably, nickel is present in an amount ranging from about 17.5 to 20.0 w/o.

In the alloy of this invention, manganese acts as a strong austenite stabilizer and serves to prevent the formation of a significant ferritic crystal structure in the alloy of this invention when the alloy is significantly decarburized and/or cold worked. From about 3.0 to 7.0 w/o manganese can be present in the alloy, but about 4.5 to 6.5 w/o manganese is preferred to assure that the alloy has the desired combination of thermal expansivity, electrical resistivity and resistance to the transformation of austenite to a ferritic crystal structure when the alloy is significantly decarburized and/or cold worked.

In the alloy of this invention, it is preferred that the combined amount of manganese and nickel not exceed about 27.5 w/o so that the electrical resistivity of the alloy does not significantly exceed that of 22-3 alloy and so that the thermal expansivity of the alloy is not significantly less than 22-3 alloy. In the alloy of this invention, it is also preferred that combined amounts of nickel and manganese not be less than about 21.0 w/o so that the alloy has good resistance to the transformation of austenite to a ferritic crystal structure when the alloy is significantly decarburized and/or cold worked.

Chromium stabilizes the austenitic microstructure of the alloy of this invention and imparts resistance to atmospheric corrosion. Chromium also increases the electrical resistivity of the alloy. At least about 2.5 w/o chromium is present in the alloy to provide the alloy with properties, particularly corrosion resistance, comparable to 22-3 alloy. However, more than about 4.0 w/o chromium adversely affects the thermal expansivity and the electrical resistivity of the alloy. Preferably, about 2.75 to 3.5 w/o chromium is present in the alloy.

Carbon is not considered essential to the alloy of this invention although at least about 0.005 w/o will usually be present. Carbon is a strong austenite former and is about thirty (30) times as effective as nickel. Hence, up to about 0.5 w/o carbon can be used beneficially in the alloy. However, carbon also hardens the alloy, thereby making the alloy more difficult to mechanically bond to a low thermal expansion alloy in making a bimetal. Hence, carbon is preferably limited to about 0.2 w/o maximum. It is also preferred that the carbon content of the alloy of this invention be high enough, preferably at least about 0.05 w/o, so that, after any decarburization process used in making a bimetal, the carbon content of the alloy is high enough, preferably at least about 0.018 w/o, to provide the alloy with a microstructure with at least about 97% austenite.

The alloy of this invention is readily prepared using standard metallurgical procedures and equipment. For example, it can be prepared in an electric arc furnace or an induction furnace. It can be melted in air, or if desired, it can be melted under vacuum or a protective atmosphere. The alloy can be readily hot worked in stages from an ingot to provide, for example, strip suitable for forming into a bimetal. In this regard, hot working of the alloy is preferably carried out from a furnace temperature of about 2000 to 2200 F. (about 1090 to 1200 C.). Strip formed of the alloy, following the usual preparation, can be readily cold rolled and can be annealed, when necessary, at a temperature of about 1600 to 2000 F. (about 870 to 1090 C.). When desired, lower annealing temperatures can be used, but longer exposure times may be required.

Annealed strip, formed from the alloy of this invention, can be mechanically bonded to a strip of a conventional low thermal expansion alloy such as Invar "36" to form a lamination. Such mechanical bonding can be carried out by a conventional cold rolling procedure, for example, by passing the strips between rolls which apply pressure to them to reduce significantly their cross-sectional areas. The resulting mechanically bonded laminate then can be sintered in a conventional manner in a reducing (e.g., hydrogen) or protective (e.g., argon) atmosphere to enhance the mechanical bond. The laminate then can be cold rolled in a conventional manner to at least about a 50% reduction in thickness to impart the desired mechanical properties (e.g., tensile and yield strength) to the resulting bimetal strip.

The examples, which follow, illustrate the alloy of this invention.

EXAMPLES 1 TO 4

Small experimental heats of 22-3 alloy and four alloys of this invention (Examples 1–4) were vacuum melted and analyzed as set forth in Table I, below. The ingot from each heat was forged from a furnace temperature of 2000 F. (1094 C.) to a bar of 1.75×0.75 inch (4.4×1.9 cm) cross-section. Portions of each bar were machined to remove any surface scale and then were hot rolled from a furnace temperature of 2000 F. (1094 C.) to form strips with a thickness of 0.220 inch (0.56 cm). The hot rolled strips were then pickled in a solution comprising equal parts of hydrochloric acid and water and cold rolled to effect a 50% reduction in thickness to 0.110 inch (0.28 cm). Portions of the cold rolled 0.110 inch (0.28 cm) strips were annealed at 1800 F. (982 C.) for one (1) hour and then allowed to cool in the furnace to ambient temperature (about 25 C.). Portions of the annealed 0.110 inch (0.28 cm) strips were then further cold rolled: to effect a further 50% reduction in thickness to 0.055 inch (0.14 cm); to effect a further 70% reduction in thickness to 0.033 inch (0.08 cm); or to effect a further 85% reduction in thickness to 0.016 inch (0.04 cm). Portions of the further cold rolled 0.055 inch (0.14 cm) strips were decarburized by heating in a dry hydrogen gas atmosphere at 1800 F. (982 C.) for sixteen (16) hours and then were allowed to cool in the furnace to ambient temperature. A small portion of the decarburized 0.055 inch (0.14 cm) strip from the heat of Example 3 was still further cold rolled to effect a still further, approximately 80% reduction in thickness to 0.010 inch (0.025 cm).

TABLE I

| | Elements* (w/o) | | | | | |
|---|---|---|---|---|---|---|
| Heats | C | Mn | Si | Cr | Ni | Fe |
| 22-3 Alloy | .106 | .42 | .33 | 3.34 | 22.42 | Bal. |
| Ex. 1 | .106 | 3.73 | .33 | 3.32 | 22.02 | Bal. |
| Ex. 2 | .116 | 3.90 | .33 | 3.37 | 18.59 | Bal. |
| Ex. 3 | .116 | 5.81 | .33 | 3.37 | 18.60 | Bal. |
| Ex. 4 | .104 | 6.14 | .34 | 3.40 | 16.74 | Bal. |

*Mo was less than .01 w/o, and P and S were each no more than .003 w/o.

The thermal expansivity was measured of: (1) a portion of the 0.110 inch (0.28 cm) strip from each heat as 50% cold rolled (the "cold rolled" strip); (2) a portion of the 0.110 inch (0.28 cm) strip from each heat as 50% cold rolled and subsequently annealed (the "annealed" strip); and (3) a portion of the 0.055 inch (0.14 cm) strip from each heat as further 50% cold rolled and then decarburized (the "decarburized" strip). The thermal expansivity was measured according to ASTM E228-71 from 4×0.25×0.110 or 0.055 inch (10.2×0.6×0.28 or 0.14 cm) dilatometer specimens over temperature ranges from 75 F. (24 C.) to: 200 F. (93 C.), 300 F. (149 C.), 500 F. (260 C.) and 700 F. (371 C.). The carbon content of a portion of each "decarburized" strip was analyzed. The percent austenite of a portion of each "annealed" strip and each "decarburized" strip was also determined, using X-ray diffraction analysis. The results are set forth in Table II, below.

TABLE II

| Heats | Strips | Thermal Expansion Coefficients (in/in/°F. × $10^{-6}$) 200° F. | 300° F. | 500° F. | 700° F. | Carbon Contents* (w/o) | Austenite Contents (%) |
|---|---|---|---|---|---|---|---|
| 22-3 Alloy | cold rolled | 10.20 | 10.37 | 10.63 | 10.86 | .106 | — |
| | annealed | 10.48 | 10.54 | 10.78 | 10.93 | — | 90 |
| | decarburized | 8.18 | 8.66 | 8.80 | 8.90 | .017 | 53 |
| Ex. 1 | cold rolled | 10.50 | 10.50 | 10.80 | 11.00 | .106 | — |
| | annealed | 10.20 | 10.37 | 10.63 | 10.86 | — | 100 |
| | decarburized | 10.41 | 10.60 | 10.80 | 10.94 | .033 | 100 |
| Ex. 2 | cold rolled | 10.38 | 10.59 | 10.85 | 11.06 | .116 | — |
| | annealed | 10.47 | 10.60 | 10.89 | 11.15 | — | 100 |
| | decarburized | 10.21 | 10.69 | 10.93 | 11.10 | .018 | 100 |
| Ex. 3 | cold rolled | 10.38 | 10.45 | 10.67 | 11.01 | .116 | — |
| | annealed | 10.63 | 10.82 | 11.15 | 11.41 | — | 100 |
| | decarburized | 10.42 | 10.81 | 10.99 | 11.23 | .051 | 100 |
| Ex. 4 | cold rolled | 10.64 | 10.70 | 10.85 | 10.97 | .104 | — |
| | annealed | 10.38 | 10.59 | 10.92 | 11.26 | — | 100 |
| | decarburized | 9.78 | 10.53 | 10.93 | 11.15 | .044 | 100 |

*The carbon content of each of the "cold rolled" strips was assumed to be the same as the carbon content of its ingot.

Table II shows that, after significant decarburization, the thermal expansivity and austenite content of 22-3 alloy decreased significantly. By comparison, the thermal expansivity of each alloy of this invention, after significant decarburization, remained relatively constant at a value comparable to the thermal expansivity (about 10 to 11 in/in/°F.×$10^{-6}$) of 22-3 alloy before significant decarburization, and the austenite content of each alloy of this invention remained essentially unchanged at about 100% after significant decarburization.

The magnetic permeability was measured of: (1) a portion of the 0.110 inch (0.28 cm) strip from each heat at 50% cold rolled and then annealed (the "annealed" strip); (2) a portion of the 0.55 inch (0.14 cm) strip from each heat as further 50% cold rolled (the "50% cold rolled" strip); (3) a portion of the 0.016 inch (0.04 cm) strip from each heat as further 85% cold rolled (the "85% cold rolled" strip); and (4) the 0.010 inch (0.025 cm) strip from the heat of Example 3 as decarburized and then still further 80% cold rolled (the "decarburized and 80% cold rolled" strip). The magnetic permeability was measured by comparing each strip portion with standards of known magnetic permeability, using a Severn guage manufactured by Severn Engineering Company, Annapolis, Md. In these measurements, air was assumed to have a magnetic permeability of one (1). A portion of each "annealed" strip and each 50% cold rolled" strip was also subjected to X-ray diffraction analysis to determine its austenite content. The results are set forth in Table III, below.

TABLE III

| Heats | Magnetic Permeabilities: Annealed strips | 50% Cold rolled strips | 85% Cold rolled strips | Decarburized and 80% cold rolled strips | Austenite Contents (%): Annealed strips | 50% Cold rolled strips |
|---|---|---|---|---|---|---|
| 22-3 Alloy | 1.05-1.2 | 2-3 | >3 | — | 90 | 81 |
| Ex. 1 | 1.01-1.02 | 1.01-1.02 | 1.01-1.02 | — | 100 | 100 |
| Ex. 2 | <1.01 | 1.02-1.05 | 1.02-1.05 | — | 100 | 100 |
| Ex. 3 | <1.01 | <1.01 | 1.01-1.02 | 1.01-1.02 | 100 | 100 |
| Ex. 4 | <1.01 | <1.01 | 1.01-1.02 | — | 100 | 100 |

Table III shows that, after significant cold rolling, the magnetic permeability of 22-3 alloy increased significantly. By comparison, the magnetic permeability of each of the alloys of this invention, after significant cold rolling, remained relatively constant at a value not significantly different from the magnetic permeability (1.05 to 1.2) of 22-3 alloy before cold rolling. This indicates that a significant transformation from austenite to a ferritic crystal structure occurred in 22-3 alloy when it was significantly cold worked whereas such a significant transformation did not occur in the alloys of this invention. This conclusion is corroborated by the data in Table III regarding the austenite contents of the tested strips.

The tensile properties were measured of duplicate specimens of: (1) the 0.055 inch (0.14 cm) strip from each heat as further 50% cold rolled (the "cold rolled 0.055 inch" strip); and (2) the 0.033 inch (0.08 cm) strip from each heat as further 70% cold rolled (the "cold rolled 0.033 inch" strip). The tensile properties of these specimens were measured utilizing the procedures of ASTM E8-69. Additional specimens of the tested strips were annealed at 1800 F. (982 C.) for three (3) minutes and then air cooled to ambient temperature, and the tensile properties of the additional specimens (the "annealed 0.055 inch" strips and the "annealed 0.033 inch" strips) were measured utilizing the procedures of ASTM E8-69. The results are set forth in Table IV, below.

TABLE IV

| Heats | Strips | Tensile Properties: 0.2% Yield Strengths (ksi) | Ultimate Tensile Strengths (ksi) | Percent Elongations in two (2) inches (5.1 cm) |
|---|---|---|---|---|
| 22-3 Alloy | cold rolled .055 inch | 109.9 | 110.3 | 9.6 |
| | annealed .055 inch | 20.3 | 70.6 | 42.1 |
| | cold rolled .033 inch | 129.6 | 129.6 | 6.3 |
| | annealed .033 inch | — | 70.7 | 46.1 |
| Ex. 1 | cold rolled .055 inch | 114.5 | 115.2 | 5.3 |
| | annealed .055 inch | 22.2 | 69.8 | 43.2 |
| | cold rolled .033 inch | 125.8 | 127.3 | 3.0 |
| | annealed .033 inch | 21.6 | 67.2 | 38.1 |
| Ex. 2 | cold rolled .055 inch | 120.2 | 121.1 | 4.7 |
| | annealed .055 inch | — | 71.8 | 46.5 |
| | cold rolled .033 inch | 140.4 | 142.6 | 3.3 |
| | annealed .033 inch | 23.2 | 72.7 | 44.4 |
| Ex. 3 | cold rolled .055 inch | 122.6 | 124.9 | 4.3 |
| | annealed .055 inch | 23.4 | 72.8 | 45.6 |
| | cold rolled .033 inch | 134.6 | 136.5 | 4.0 |
| | annealed .033 inch | 23.2 | 72.8 | 44.2 |
| Ex. 4 | cold rolled .055 inch | 124.0 | 125.1 | 6.3 |
| | annealed .055 inch | 22.8 | 72.2 | 44.3 |
| | cold rolled .033 inch | 142.2 | 144.6 | 5.4 |
| | annealed .033 inch | 22.5 | 72.4 | 44.5 |

Table IV shows that the alloys of this invention and 22-3 alloy have tensile properties which are not significantly different after the alloys have been cold rolled and annealed in a manner which simulates steps (e.g., significant cold working) in the manufacture of bimetals from 22-3 alloy.

The electrical resistivity was measured of the 0.016 inch (0.04 cm) strip from each heat as further 85% cold rolled (the "cold rolled" strip). The electrical resistivity was measured with a Kelvin bridge. The strips were subsequently annealed at 1800 F. (982 C.) for one (1) hour and then allowed to cool to ambient temperature in the furnace. The electrical resistivity of each of the resulting "annealed" strips was then measured with a Kelvin bridge. The results are set forth in Table V, below.

TABLE V

| Heats | Electrical Resistivities of Cold Rolled Strips (ohm-cir mil/ft) | Electrical Resistivities of Annealed Strips (ohm-cir mil/ft) |
|---|---|---|
| 22-3 Alloy | 456 | 457 |
| Ex. 1 | 482 | 482 |
| Ex. 2 | 469 | 444 |
| Ex. 3 | 471 | 464 |
| Ex. 4 | 450 | 444 |

Table V shows that the alloys of this invention and 22-3 alloy have electrical resistivities which are not significantly different after the alloys have been cold rolled and annealed in a manner which simulates steps (e.g., significant cold working) in the manufacture of bimetals from 22-3 alloy.

The hardness was measured of: (1) the 0.110 inch (0.28 cm) strip from each heat as 50% cold rolled and then annealed (the "annealed 0.110 inch" strip); and (2) the 0.055 inch (0.14 cm) strip from each heat as further 50% cold rolled (the "cold rolled 0.055 inch" strip). The results are set forth in Table VI, below.

TABLE VI

| Heats | Hardnesses of Annealed 0.110 inch Strips (Rockwell B) | Hardnesses of Cold Rolled .055 inch Strips (Rockwell C) |
|---|---|---|
| 22-3 Alloy | 45.0 | 20.0 |
| Ex. 1 | 45.0 | 19.0 |
| Ex. 2 | 46.5 | 22.5 |
| Ex. 3 | 47.0 | 23.5 |
| Ex. 4 | 48.0 | 23.0 |

Table VI shows that the alloys of this invention and 22-3 alloy have hardness properties which are not significantly different after these alloys have been cold rolled and annealed in a manner which simulates steps (e.g., significant cold working) in the manufacture of bimetals from 22-3 alloy.

The austenite content was measured by x-ray diffraction analysis of: (1) a portion of the 0.110 inch (0.28 cm) strip from each heat as 50% cold rolled and then annealed (the "annealed" strip); (2) a portion of the 0.55 inch (0.14 cm) strip from each heat as further 50% cold rolled (the "50% cold rolled" strip); and (3) a portion of the 0.55 inch (0.14 cm) strip from each heat as further 50% cold rolled and the decarburized (the "decarburized" strip). Each strip portion was subsequently cold treated by immersing it in methanol and dry ice at −76 C. for four hours, and then, the austenite content of each strip portion (the "−76 C. treated" strip) was again measured. Each strip portion was thereafter cold treated by immersing it in liquid nitrogen at −196° C. for four hours, and then, the austenite content of each strip portion (the "−196 C. treated" strip) was again measured. The results are set forth in Table VII, below.

TABLE VII

| Strips | 22-3 Alloy | Austenite Contents (%): Ex. 1 | Ex. 2 | Ex. 3 | Ex. 4 |
|---|---|---|---|---|---|
| annealed | 90 | 100 | 100 | 100 | 100 |
| −76 C. treated | 39 | 100 | 100 | 100 | 100 |
| −196 C. treated | 45 | 100 | 100 | 100 | 100 |
| 50% cold rolled | 81 | 100 | 100 | 100 | 100 |
| −76 C. treated | 64 | 100 | 100 | 100 | 100 |
| −196 C. treated | 67 | 100 | 100 | 100 | 100 |
| Decarburized | 53 | 100 | 100 | 100 | 100 |
| −76 C. treated | 11 | 100 | 97 | 100 | 100 |
| −196 C. treated | 15 | 100 | 98 | 100 | 100 |

Table VII shows that, after cold treatment down to −76 C. and down to −196 C., the austenite content of 22-3 alloy decreased significantly. By comparison, the austenite content of each alloy of this invention, after cold treatment down to −76 C. and down to −196 C., was essentially unchanged and was at least about 97%. This shows that each of the alloys of this invention has much greater resistance than 22-3 alloy to the transformation of its austenite to a ferritic crystal structure when the alloy is cooled, for example, down to −76 C. or −196 C. As a result, each alloy of this invention can be used as the high expansion element of a temperature sensitive bimetal over a much wider range of temperatures than 22-3 alloy and is better adapted than 22-3 alloy for use in low temperature environments.

EXAMPLE 5

Small experimental heats of 22-3 alloy and an alloy of this invention (Example 5) were prepared and analyzed as set forth in Table VIII, below.

TABLE VIII

| Heats | C | Elements* (w/o) Mn | Si | Cr | Ni | Fe |
|---|---|---|---|---|---|---|
| 22-3 Alloy | .099 | 0.40 | 0.33 | 3.26 | 22.17 | Bal. |
| Ex. 5 | .099 | 3.80 | 0.33 | 3.26 | 18.14 | Bal. |

*Co was less than 0.1 w/o, P and S were each no more than .004 w/o, and Mo, Cu and Al were each less than .05 w/o.

The ingot from each heat was forged from a furnace temperature of about 2100 F. (about 1150 C.) to a 0.75 inch (1.9 cm) square bar. Four (4) corrosion resistance test specimens were machined from each bar. Each specimen was a 1 inch (2.54 cm) long, 0.5 inch (1.27 cm) diameter cylinder for half its length and tapered to a 60° cone. The specimens were annealed in hydrogen at about 1400 F. (about 760 C.) for one (1) hour. An oxide film formed on the specimens during the annealing, and the film was removed from two of the specimens from each heat by grinding.

After cleaning in methanol, the specimens were subjected to a 100% relative humidity atmosphere at 95 F. (35 C.). All the unground specimens showed signs of rusting within the first half hour of exposure. After about six (6) hours, rust covered 20 to 40% of the surface area of one of the unground specimens of 22-3 alloy and 40 to 60% of the surface area of the other unground specimen of 22-3 alloy, and rust covered more than 80% of the surface area of the two unground specimens of Example 5. Among the ground specimens of 22-3 alloy, one specimen had rust on 1 to 3% of its surface area after 48 hours of exposure, the other specimen did not have any rust until after 94 hours of exposure, and after 164 hours, one specimen had 1 to 3% of its surface area covered by rust spots while the other had somewhat more rust but less than 5% of its surface area was rusted. Among the ground specimens of Example 5, only one showed any rust spots after exposure for 94 hours, and after 164 hours, rust spots were present on only 1% to 3% of the surface area of each of the two specimens.

As a further and more severe test, the ground specimens were then exposed to a 5% by weight salt (NaCl) spray at 95 F. (35 C.) When inspected after 22 hours, 40 to 60% of the surface area of each of the specimens was rusted, and after 46 hours, 60 to 80% of the surface area of each specimen was rusted.

These corrosion tests show that the alloys of this invention and 22-3 alloy have atmospheric corrosion resistance properties which are not significantly different.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

I claim:

1. An austenitic high expansion alloy which retains an austenite content of at least about 97% when significantly decarburized and cold worked to a reduction of at least about 80% in thickness, consisting essentially in weight percent of about:

| | w/o |
|---|---|
| Manganese | 5.81 |
| Chromium | 3.37 |
| Nickel | 18.60 |

and the balance being essentially iron.

2. A temperature-sensitive bimetal strip wherein the high thermal expansion element is the alloy of claim 1.

3. A significantly cold worked and significantly decarburized, high expansion alloy of claim 1 with an austenite content of about 100%.

* * * * *